United States Patent [19]

Butterwick

[11] 4,396,859

[45] Aug. 2, 1983

[54] PHOTOMULTIPLIER ASSEMBLY HAVING UNIVERSAL ALIGNMENT MEANS

[75] Inventor: Gilbert N. Butterwick, Leola, Pa.

[73] Assignee: RCA Corporation, New York, N.Y.

[21] Appl. No.: 257,774

[22] Filed: Apr. 27, 1981

[51] Int. Cl.[3] ..... H01J 1/53; H01J 43/00

[52] U.S. Cl. ..... 313/240; 313/356; 313/103 R; 313/292

[58] Field of Search ..... 313/103 R, 238, 239, 313/240, 242, 292, 326, 340, 356

[56] References Cited

U.S. PATENT DOCUMENTS

| | | | |
|---|---|---|---|
| 2,425,682 | 8/1947 | Liebmann | 313/240 |
| 2,493,919 | 1/1950 | Holmes | 201/63 |
| 2,518,048 | 8/1950 | Moore | 250/165 |
| 3,109,050 | 10/1963 | Lusic | 174/35 |
| 3,152,217 | 10/1964 | Balchaitis | 174/35 |
| 3,614,519 | 10/1981 | Figlewicz et al. | 313/240 X |
| 3,716,739 | 2/1973 | Say | 313/242 X |
| 4,115,722 | 9/1978 | Johnson | 313/242 X |
| 4,218,712 | 8/1980 | Clymer et al. | 358/229 |
| 4,220,890 | 9/1980 | Beekmans | 313/240 |

OTHER PUBLICATIONS

Photomultiplier Handbook, RCA PMT-62, pp. 45-47, 76 and 89-90.

*Primary Examiner*—Eugene R. LaRoche
*Assistant Examiner*—Vincent DeLuca
*Attorney, Agent, or Firm*—Eugene M. Whitacre; Dennis H. Irlbeck; Vincent J. Coughlin, Jr.

[57] ABSTRACT

A photomultiplier assembly includes a tubular member of high magnetic permeability and a photomultiplier tube disposed within the tubular member. The photomultiplier tube has an encapsulated voltage distribution network attached thereto. A universal member extends longitudinally along at least a portion of the photomultiplier tube and provides a slip-fit between the photomultiplier tube and the tubular member so as to space the photomultiplier tube from the tubular member. The universal member has a retaining shoulder which projects radially inwardly between the photomultiplier tube and the voltage distribution network. A plurality of locking members are affixed between the universal member and the tubular member.

13 Claims, 3 Drawing Figures

PHOTOMULTIPLIER ASSEMBLY HAVING UNIVERSAL ALIGNMENT MEANS

BACKGROUND OF THE INVENTION

This invention relates to a photomultiplier assembly and particularly to an assembly in which a photomultiplier tube is aligned within a magnetic shield.

All photomultiplier tubes are sensitive, to some extent, to the presence of external magnetic and electrostatic fields. These fields may deflect electrons from their normal path between stages of the photomultipler tube and cause a loss of gain. Tubes designed for scintillation counting are generally very sensitive to magnetic fields because of the relative long path from the photocathode to the first dynode of the photomultiplier tube; consequently, such tubes ordinarily require electrostatic and magnetic shielding. Magnetic fields may reduce the anode current of the photomultiplier tube by as much as 50 percent or more of the "no-field" value.

High-mu material i.e., material of high magnetic permeability, in the form of foil or preformed shields is available commercially for most photomultiplier tube shielding applications. When such a shield is used, it is generally operated at photocathode potential. In scintillation counting applications it is recommended that the photocathode be operated at ground potential so that a potential gradient does not exist across the glass faceplate of the photomultiplier tube. Such a potential gradient would cause scintillations to occur within the glass and increase the dark current of the tube.

One method used to shield the photomultiplier tube is to encapsulate the tube, including its voltage divider network, within a flexible silastic potting material and to attach the encapsulated tube and network with an adhesive to the interior surface of a mu-metal magnetic shield. Such a structure is satisfactory for operating temperatures near room temperature, however, the above described encapsulated structure is unsatisfactory for operation in a high temperature environment. At temperatures of about 150° C. the silastic encapsulating material expands more rapidly than either the glass envelope of the photomultiplier tube or the mu-metal shielding and the resultant force compresses and ruptures the photomultiplier tube.

SUMMARY OF THE INVENTION

A photomultiplier assembly includes a tubular member a high magnetic permeability having a photomultiplier tube disposed within the tubular member. The photomultiplier tube includes an encapsulated voltage distribution means attached thereto. Alignment means, including a universal member, extends longitudinally along at least a portion of the photomultiplier tube and provides a slip-fit between the photomultiplier tube and the tubular member so as to space the photomultiplier tube from the tubular member. The universal member has a retaining shoulder projecting radially inwardly between the photomultiplier tube and the voltage distribution means. Securing means is affixed between the universal member and the tubular member.

DESCRIPTION OF THE PREFERRED EMBODIMENT

Figure 1:
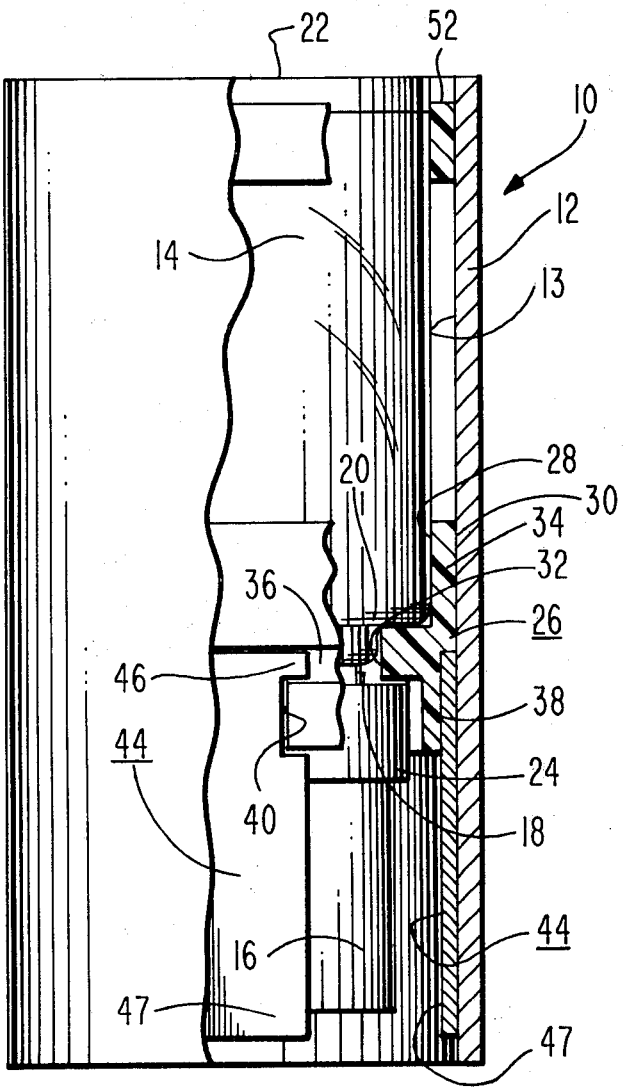
FIG. 1 is a longitudinal view partially broken away of a photomultiplier assembly.

Referring to the drawings, there is shown in FIG. 1 a photomultiplier assembly 10 comprising an open ended tubular member 12 having an inside surface 13. The tubular member 12 comprises a high magnetic permeability material such as mu-metal having a composition of about 71 to 78 parts nickel, 4.3 to 6 parts copper, 0 to 2 parts chromium and the balance iron. Such a material is readily available as either thin foil sheets or preformed cylindrical tubing.

Within the tubular member 12 and spaced from the inside surface 13 thereof is a photomultiplier tube 14 and a voltage divider 16 which is encapsulated in a silastic material such as GE-RTV silastic rubber.

The photomultiplier tube 14 has a plurality of leads 18 (only one of which is shown) extending from a stem 20 which is located opposite an input faceplate 22 of the photomultiplier tube. The leads 18 extend through a plurality of stem lead apertures (not shown) which have formed in a lead spacing base 24 formed from an insulative material such as Teflon. The lead spacing base 24 is retained in place by a plurality of eyelets (not shown) which are disposed over the leads 18 and secured thereto, for example by welding.

Located between the lead spacing base 24 and the photomultiplier tube stem 20 is a universal member 26 formed from an insulative material such as Teflon. The universal member 26 has an inside surface 28 and an outside surface 30. A retaining shoulder 32 projects radially inwardly from the inside surface 28 of the universal member 26 and extends between the lead spacing base 24 and the stem 20 of the photomultiplier tube 14. The universal member 26 also includes a first cylindrical portion 34 which extends longitudinally along a portion of the photomultiplier tube 14 adjacent to the stem 20 and provides a slip-fit between the photomultiplier tube and the inside surface 13 of the tubular member 12.

Figure 2:
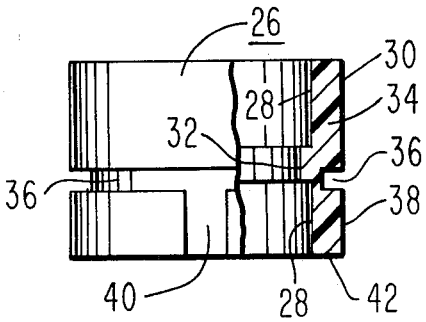
FIG. 2 is a plan view, partially broken away, of the novel universal member.

As shown in FIG. 2, the universal member 26 has a circumferential notch 36 formed in the outside surface 30 thereof. The universal member 26 has a second cylindrical portion 38 which extends longitudinally along at least a portion of the lead spacing base 24. A plurality of longitudinal grooves 40 are formed in the outside surface of the universal member 26 and extend from the circumferential notch 36 to an end 42 of the universal member 26. The longitudinal grooves 40 are oppositely disposed around the universal member 26 and in the preferred embodiment comprise four grooves spaced 90° apart. The inside surface portion 28 of the universal member 26 which extends longitudinally along the lead spacing base 24 is radially spaced from the lead spacing base 24 to permit radial movement of the lead spacing base 24 or misalignment of the stem 20 without exerting any pressure on the universal member 26.

Figure 3:
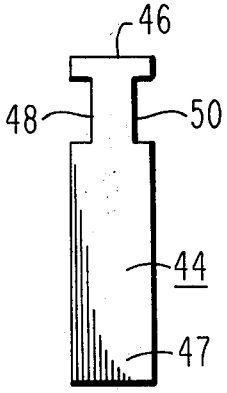
FIG. 3 is a plan view of a locking member.

A plurality of locking members 44, such as that shown in FIG. 3, are disposed within the longitudinal grooves 40 of the universal member 26. Each of the locking members 44 has a first end 46 and a second end 47. The first end 46 is T-shaped and has a pair of indentations 48 and 50 formed in the body thereof adjacent to the first end 46. The indentations 48 and 50 permit the locking members 44 to fit within the grooves 40 and to be secured within the notch 36 as shown in FIG. 1. The locking members 44 are selected from a material which has a coefficient of thermal expansion closely matching both that of the mu-metal cylinder 12 and the glass of the photomultiplier tube 14. The material for the locking members 44 preferably comprises stainless steel. The locking members 44 are thick enough to provide a flush fit between the outside surface 30 of the universal member 26 and the inside surface 13 of the tubular member 12.

An annular spacer 52 of an insulating material such as Teflon, is disposed adjacent to the faceplate 22 of the photomultiplier tube 14 and between the photomultiplier tube 14 and the inside surface 13 of the tubular member 12. The annular spacer 52 provides a slip-fit with the inside surface 13 of the tubular member 12.

In order to assemble the photomultiplier tube assembly 10, the photomultiplier tube 14, the universal member 26, the annular spacer 52, the lead spacing base 24 and the voltage divider network 16 are slid into one end of the tubular member 12 until the faceplate 22 of the photomultiplier tube 14 is flush with the end of the tubular member 12. The four locking members 44 are disposed within the circumferential notch 36 and the longitudinal grooves 40 of the universal member 26 so that the locking members 44 are retained between the universal member 26 and the inside surface 13 of the tubular member 12. Each of the ends 47 of the locking members 44 is disposed adjacent to the other end of the tubular member 12 and is attached, for example, by electric resistance welding, to the inside surface 13 of the tubular member 12.

The selection of Teflon for the annular spacer 52, the lead spacing base 24 and for the universal member 26 as well as the selection of stainless steel for the locking members 44 provides a close thermal match between these components and the mu-metal shield 12 and the photomultiplier tube 14 of the photomultiplier assembly 10. It has been determined that the photomultiplier assembly 10 may be thermally cycled to temperatures in excess of 150° C. without deleterious effects on the photomultiplier tube 14.

What is claimed is:

1. A photomultiplier assembly including:

a tubular member of high magnetic permeability, a photomultiplier tube disposed within said tubular member, said photomultiplier tube having encapsulated voltage distribution means attached thereto, alignment means including a universal member extending longitudinally along at least a portion of said photomultiplier tube, said universal member providing a slip-fit between said photomultiplier tube and said tubular member spacing said photomultiplier tube from said tubular member, said universal member having a retaining shoulder projecting radially inwardly between said photomultiplier tube and said voltage distribution means, and securing means affixed between said universal member and said tubular member.

2. The assembly as in claim 1 wherein said photomultiplier tube comprises a substantially cylindrical evacuated envelope having a faceplate at one end and a stem portion at the other end, said stem portion having a plurality of stem leads vacuum sealed therethrough.

3. The assembly as in claim 2, further including a lead spacing base disposed between said retaining shoulder of said universal member and said voltage distribution means, said base having a plurality of stem lead apertures therethrough.

4. The assembly as in claim 3, wherein each of said stem leads extends through a different one of said stem lead apertures in said lead spacing base.

5. The assembly as in claim 4, wherein said encapsulated voltage distribution means is attached to said stem leads extending through said lead apertures of said spacing base.

6. The assembly as in claim 2, wherein said alignment means further includes an annular spacer adjacent to said envelope faceplate and disposed between said envelope and said tubular member.

7. The assembly as in claim 6 wherein said annular spacer and said universal member comprise an insulative material.

8. The assembly as in claim 3, wherein said universal member also extends longitudinally along at least a portion of said lead spacing base and is radially spaced therefrom.

9. The assembly as in claim 8 wherein a circumferential notch is formed in an outside surface of said universal member, said outside surface of said universal member further including a plurality of oppositely disposed longitudinal grooves formed therein extending from said circumferential notch to an end of said universal member adjacent to said lead spacing base.

10. The assembly as in claim 9, where said securing means comprises a locking member having a first end formed to fit flushly within a portion of said circumferential notch and said longitudinal groove of said universal member, said first end being retained between said universal member and said tubular member, said locking member have a second end, opposite said first end, said second end being fixedly attached to said tubular member.

11. A photomultiplier assembly including:

a tubular member of high magnetic permeability, a photomultiplier tube disposed within said tubular member, said photomultiplier tube having an input faceplate and a stem located opposite therefrom, said stem having a plurality of leads extending therefrom, said leads extending through a lead spacing base, said photomultiplier tube having encapsulated voltage distribution means attached thereto, an annular spacer disposed adjacent to said faceplate, a universal member extending longitudinally along at least a portion of said photomultiplier tube, said universal member and said annular spacer providing a slip-fit between said photomultiplier tube and said tubular member spacing said photomultiplier tube from said tubular member, said universal member having an inside surface and an outside surface, said inside surface having a retaining shoulder which projects radially inward therefrom and extends between said lead spacing base and said stem, said outside surface having a plurality of recesses therein, and a plurality of locking members, each locking member having a first end formed to fit flushly with one of said recesses of said universal member, said first end being retained between said universal member and said tubular member, said locking members having a second end fixedly attached to said tubular member.

12. The assembly as in claim 11 wherein said plurality of recesses include a circumferential notch formed in an outside surface of said universal member, and a plurality of oppositely disposed longitudinal grooves formed therein extending from said circumferential notch to an end of said universal member adjacent to said lead spacing base.

13. The assembly as in claim 10 or 11 wherein said locking member comprises a material having a coefficient of thermal expansion closely matching that of said tubular member.

* * * * *